United States Patent [19]

Yamamoto et al.

[11] Patent Number: 4,521,248

[45] Date of Patent: Jun. 4, 1985

[54] PROCESS FOR PRODUCING TITANIUM NITRIDE BASE CERMETS WITH HIGH TOUGHNESS

[75] Inventors: Yoshihiro Yamamoto, Iwakura; Junichiro Suzuki, Gifu; Minoru Nakamura, Komaki, all of Japan

[73] Assignee: NGK Spark Plug Co., Ltd., Aichi, Japan

[21] Appl. No.: 642,946

[22] Filed: Aug. 20, 1984

Related U.S. Application Data

[63] Continuation-in-part of Ser. No. 473,653, Mar. 9, 1983.

[30] Foreign Application Priority Data

Mar. 16, 1982 [JP] Japan ..... 57-41555

[51] Int. Cl.[3] ..... C22C 1/05; B22F 3/16; B22F 1/00

[52] U.S. Cl. ..... 75/238; 419/13; 419/16; 419/45; 419/60

[58] Field of Search ..... 419/14, 16, 13, 45, 419/60; 75/238

[56] References Cited

U.S. PATENT DOCUMENTS 4,330,333 5/1982 Gibbs ..... 419/16 X

*Primary Examiner*—Ben R. Padgett
*Assistant Examiner*—Matthew A. Thexton
*Attorney, Agent, or Firm*—Wegner & Bretschneider

[57] ABSTRACT

A process for producing titanium nitride base cermet with a high toughness comprises the steps of:

admixing 0.5 to 10 parts by volume of a carbon powder with a cermet material powder in an amount of 100 parts by volume based on nitrides in the cermet material powder, the cermet material powder essentially consisting of, by weight, 40 to 93% TiN, 2 to 15% of one or more selected from the group consisting of metals of the Group VIa of the periodic table and carbides thereof, 4.7 to 35% of iron group metal, and 0.3 to 10% of AlN with the balance being inevitable impurities, compacting and sintering whereby when the compact is sintered, said AlN is substantially decomposed.

TiN may be partly replaced with carbides and/or carbonitrides of metals of the Groups IVa and Va of the periodic Table.

22 Claims, No Drawings

PROCESS FOR PRODUCING TITANIUM NITRIDE BASE CERMETS WITH HIGH TOUGHNESS

REFERENCE TO THE EARLIER APPLICATION

This application is a continuation-in-part application of the parent application Ser. No. 473,653 filed on Mar. 9, 1983.

BACKGROUND

The present invention relates to a process for producing a material for cutting tools, which has high toughness and strength and excels in the resistance to both abrasion and plastic deformation, and to products produced by the process.

Japanese Patent Kokai Publication No. 54-30209 discloses a cutting tool material obtained by adding AlN to TiN-containing TiC base cermet. Although that cermet is known to have been improved with respect to cutting and mechanical properties, it is still not sufficient in strength since the base material per se has still a low strength, in spite of the fact that the AlN addition contributes somewhat to the increase in strength. At present, therefore, it is little used for heavy duty cutting, high impact milling or intermittent cutting. On the other hand, TiN base cermets excel in fracture toughness and stand up to thermal shock but, since TiN per se shows unsatisfactory wetting compatibility with bonding metals of the iron group, they have such an increased number of pores that they are deficient in strength and in resistance to both abrasion and plastic deformation.

SUMMARY OF THE DISCLOSURE

The present invention has been accomplished with a view to reducing or eliminating the drawbacks of the prior art as mentioned above, and has for its object to provide a novel process for producing titanium nitride base cermets with high toughness.

The present invention provides a process for producing titanium nitride base cermet with high toughness comprising the steps of:

admixing 0.5 to 10 parts by volume of a carbon powder with a cermet material powder in the amount of 100 parts by volume based on the nitrides in the cermet material powder, the cermet material powder consisting essentially of, by weight, 40 to 93% TiN, 2 to 15% of one or more selected from the group consisting of metals of the Group VIa of the periodic table and carbides therof, 4.7 to 35% of iron group metal, and 0.3 to 10% of AlN with the balance being inevitable impurities, forming the resultant mixture into a compact, and sintering the resultant compact.

The present invention provides a variation of the aforementioned process in which half or less of TiN is replaced with one or more of the carbides and/or carbonitrides of metal of the Groups IVa and Va of the periodic table, provided that the amount of TiN in the cermet material powder is not less than 30% by weight.

The cermets according to the present invention have been found to have significantly improved cutting properties over the prior art cermets.

According to the present invention, the addition of AlN and C to the TiN base cermets noticeably improves the wetting compatibility of TiN with bonding metals of the iron group, so that the resulting bodies have a reduced or limited number of pores.

Namely, during the sintering most of added AlN decomposes to form solid solution in the bonding matrix resulting in an improved wetting compatibility as well as solid solution hardening of the bonding matrix. Furthermore, on the case where Ni is present in the bonding matrix, which is a preferred composition, a part of Al produced by the decomposition precipitates an intermetallic compounds with Ni of a $\gamma'$ phase $\{Ni_3Al(Ti)\}$ resulting in further precipitation hardening of the bonding matrix. It is believed that in the above mentioned procedure, the carbon C present in the system effectively promotes the AlN decomposition which in turn improves said wetting compatibility of TiN ultimately resulting in the improved cutting properties. This results in improvements in mechanical strength and cutting properties which are suitable for heavy duty cutting, high impact milling, intermittent cutting or profiling cutting wherein the magnitude and direction of stresses vary during cutting, whereas such cuttings have been difficult to perform with the conventional cermet tools.

The iron group metal encompasses Ni and Co, preferably, a mixture thereof.

The metals of the Groups IVa and Va of the periodic table are defined according to the periodic table as presented in Elements of Physical Chemistry, 1960, D. Van Nostrand Co., Inc. (Maruzen Asian Edition) pp. 163 and encompass Ti, Zr, Hf, V, Nb and Ta. The carbides and/or carbonitrides of those metals at least encompass TiC, ZrC, HfC, VC, NbC, TaC, TiCN and the like, mixtures thereof being also employable.

The metals of Group VIa of the periodic table encompass Cr, Mo, W or mixtures thereof, and carbides (or any carbide) of those metals may be used either alternatively or together with those metals (or any of those metals).

PREFERRED EMBODIMENT OF THE DISCLOSURE

The cermets obtainable according to the preferred embodiments of the present invention provide an improved Rockwell hardness A scale (HRA) ranging from 88.0 or higher, preferably, 91.0 to 92.2 or higher while the cutting tests exhibit prominent improvements in cutting properties, i.e, in resistance against wear and edge failure owing to fracture.

In what follows, % will be given by weight, unless otherwise specified.

The metals of the Group VIa of the periodic table and the carbides thereof in an amount of 2 to 15%, preferably 4 to 15% and more preferably 4 to 13%, are effective in improving the wetting compatibility or wettability of the hard phases with bonding metal, and are less effective in an amount below 2%. In an amount exceeding 15%, however, it is likely that the intermediate layer phase composed of a composite carbonitride formed in the vicinity of TiN grains becomes so brittle that the resulting alloy has limited strength; in addition, the relative amount of TiN thereby reduced, with the result that the full advantageous properties of TiN or the carbides and/or carbonitrides of metals from the Groups IVa and Va of the periodic table can not be sufficiently developed.

The iron group metals bond together the hard phases to contribute to the improvement in the strength of the cermets. However, there is a drop of the strength in the cermets in amounts below 4.7%, whereas the hardness and the wear resistance of the alloys deteriorate in amounts exceeding 35%. The iron group metals preferably amounts to 4 to 25%, more preferably, 5 to 18%.

Addition of both AlN and C provides the significant improvement in the wettability of the hard phase relative to the bonding metal, due to the solid solution formation in the bonding matrix as well as the significant improvement in precipitation hardening of the bonding matrix, however, no desired effect is obtained if the content of AlN is below 0.3%, whereas there are deteriorations in the strength and the cutting properties if its content exceeds 10%. The preferable range of AlN amounts to 0.5 to 8%, more preferably 0.5 to 4%.

Desired effect is little when the amount of the added carbon is below 0.5 part by volume per 100 parts by volume of nitrides in the cermet material powder, whereas excessive carbon is deposited resulting in loss of effect and reduction of strength and cutting performance when carbon exceeds 10 parts by volume. Preferably, carbon amounts to 1 to 3 parts by volume. Carbon may be added as carbon black, e.g., acetylene black or the like. It is understood in the inventive process, added carbon will substantially remain in the sintered cermet in a sintered state with other starting materials.

TiN in the cermet material powder amounts to 40 to 93%, preferably 35 to 90%, more preferably 35 to 70%. TiN forms the hard phases defining part of the titanium nitride base cermets with the high toughness according to the present invention. No desired effect is attained with TiN amount of less than 30%, and using more than 93% reduces the amount of other bonding metal or a wettability-improving material that can be included with a drop in toughness as a consequence.

It is noted, however, that the replacement of half or less of the TiN with the carbide and/or carbonitride of an element(s) from the Group IVa and Va of the periodic table does improve the wettability of the hard phases relative to the bonding metal, and enhances as well the wear resistance and the thermal resistance of the finished cermet. However, if the amount of the substituent(s) used exceeds 50% of TiN, is the amount of TiN relatively reduced so that no advantage is taken of the inclusion of TiN entailing a drop in strength. For similar reasons, no desired effect is obtained even though the substituent(s) amount(s) to half or more of TiN, if the content of TiN is less than 30% in the cermet material powder.

The cermets produced by the process according to the present invention permit inevitable impurities listed as follows:

$O_2 < 1.0\%$, $Fe < 1.5\%$, $Cr < 0.5\%$ and traces of Na, Ca, Si, Cu, S, Mg, P, B and the like.

Those impurities are likely to be incorporated from the starting materials as well as during the manufacturing procedures.

Mixing of the starting materials is carried out by a known manner, e.g., usually employing a ball mill, during which pulverization may be effected as well.

Compacting is done in a manner which is known per se, with or without using a forming agent, e.g., paraffine or inorganic agents.

Sintering is carried out at a temperature between 1300°-1700° C., preferably 1450°-1600° C., in an inert atmosphere, preferably in an inert vacuum atmosphere, e.g., under the presence of Ar or the like.

In the following, the present invention will further be elucidated with reference to the examples which are disclosed for better understanding of the invention and not for limitation thereof.

EXAMPLES (% denotes % by weight)

Commercially available starting powdery materials of sintered bodies for cutting tools, as shown in Table 1, were mixed with 1% paraffine as a forming agent, and adjusted to such a composition as shown in Table 2, followed by being wet mixed with acetone as an organic solvent which in a stainless steel ball mill with superhard balls. The resultant powdery mixture having a mean particle size of about 0.5 micron was then dried, compacted at a pressure of 2 t/cm$^2$, and sintered at a temperature of 1450°-1500° C. for one hour in a 10 Torr Ar atmosphere to obtain cutting tool tips which, in turn, were measured for their hardness and bending strength. The tips were then cut into pieces having a size of SNGN 120408 (ISO, 12.7×12.7×4.76 mm, nose R 0.8 mm), polished, and subjected to cutting tests under the conditions as specified in Table 3. For the purpose of comparison, reference runs were carried out with compositions departing from the scope of the present invention under the identical conditions.

Note for Table 2:

1. Suffix "R" stands for reference runs.
2. Bending strength was measured by the three points bending test using 8×4×20 mm test pieces according to JIS B 4104.
3. Cermet material powder composition is given by weight %, whereas acetylene black (carbon) is given in parts by volume based on the nitrides in the cermet material powder, provided that carbonitride (e.g., TiCN) is calculated based on its nitride component (e.g., as "TiN").
4. Hardness is given in Rockwell A scale.
5. The conditions for cutting tests 1 and 2 given in Table 3.

It is evident from Table 2 that the tips obtained in Examples according to the present invention usually ensure 8 to 18 or more cutting cycles until the edges fracture finally in cutting test 2, whereas the reference tips stand up to only 5 or fewer cutting cycles. Sample Nos. 17 and 20 exhibit excellent cutting cycles of 27 and 24, respectively, though the results of cutting test 1 are insufficient. However, such Samples are suitable for use under conditions like cutting test 2.

The wear of the clearance face of the inventive tips subjected to 10-minute cutting substantially ranges from 0.9 to 0.21, whereas the wear of the reference tips amounts to 0.25 or more except for No. 13R which exhibits a low value cutting test 2. Sample No. 16 has a high hardness and shows an excellent wear resistance, compensating for the relatively lower result in cutting test 2, thus rendering it useful.

Thus, the inventive tips are by far superior to the conventional tips in various cutting properties.

TABLE 1

| | particle size | C amount etc* | grade** | impurities*** |
|---|---|---|---|---|
| TiN | 1.5μ | N21.2 wt % | 99.31 wt % | 0.32 $O_2$, C wt % |
| TiC | 1.2 | 19.7 | 99.70 | 0.29 $O_2$, $N_2$ |
| TiCN | 1.5 | TiC/TiN=50/50 | 99.08 | 0.76 $O_2$, 0.16 Fe |

TABLE 1-continued

| | particle size | C amount etc* | grade** | impurities*** |
|---|---|---|---|---|
| WC | 2.0 | 6.15 | 99.31 | 0.5 $O_2$, 0.1 Mo, Fe, Cr |
| $Mo_2C$ | 3.0 | 5.9 | 99.91 | 0.07 Fe |
| TaC | 1.0 | 6.3 | 98.85 | 0.8 Nb, 0.22 Fe, 0.12 Ti |
| HfC | 1.5 | 6.2 | 98.62 | — |
| NbC | 2.0 | 11.3 | 98.26 | — |
| ZrC | 1.2 | 11.5 | 98.11 | 1.04 Hf, 0.5 $O_2$, $N_2$, Fe |
| Vc | 2.0 | 18.9 | 98.35 | 0.4 Fe, 0.25 Al, 0.2 Cr, 0.16 Ti, 0.15 Ta |
| Mo | 0.7 | — | 99.36 | 0.58 $O_2$, Fe |
| W | 0.8 | — | 99.21 | — |
| Ni | 1.5 | — | 99.06 | 0.75 $O_2$, 0.1 Co, Fe, S |
| Co | 1.2 | — | 99.75 | 0.5 $O_2$, 0.14 Ni, C, Fe, Na, Cu |
| AlN | 1.5 | — | 99.72 | 1.45 $O_2$, 0.65 $N_2$, 0.1 Fe |
| C | — | acetylene black | | |

N.B.
*N amount for TiN
**purity
***if not specified, amount is trace.

TABLE 2

| Sample Nos. | Cermet Material Powder Composition TiN | WC | $Mo_2C$ | W Cr Mo | TiC | TiCN | TaC | HfC ZrC | NbC VC | Ni | Co | AlN | Acetylene Black parts by vol.* | Bending Strength kg/mm² | Hardness HRA | Cutting Tests 1 | 2 |
|---|---|---|---|---|---|---|---|---|---|---|---|---|---|---|---|---|---|
| 1 | 70 | 9.5 | | Mo 3 | | | | | | 11 | 5 | 1.5 | 2.4 | 177 | 91.0 | 0.186 | 13 |
| 2 | 69.8 | | 10 | W 3.7 | | | | | | 5 | 11 | 0.5 | 2.4 | 173 | 91.5 | 0.168 | 12 |
| 3 | 43 | | 7.8 | | 30 | | | | | 9 | 9 | 1.2 | 1.4 | 188 | 92.0 | 0.170 | 17 |
| 4 | 54 | | 6 | | | | 20 | HfC 5.5 | | 4 | 10 | 0.5 | 2.0 | 172 | 91.9 | 0.160 | 14 |
| 5 | 62 | | 4.7 | | | | 10 | | NbC 7.5 | 5 | 10 | 0.8 | 2.2 | 187 | 91.9 | 0.155 | 18 |
| 6 | 45 | | 7 | Cr 1.5 | 19.7 | | 10 | | | 6 | 10 | 0.8 | 1.6 | 182 | 92.2 | 0.159 | 12 |
| 7 | 55 | 5 | | Mo 3.5 | | 19.7 | | | | 8 | 8 | 0.8 | 2.2 | 174 | 92.1 | 0.149 | 15 |
| 8 | 64 | | 7 | | 9.5 | | | ZrC 1 | | 11 | 6 | 1.5 | 2.3 | 188 | 91.5 | 0.177 | 16 |
| 9 | 40 | 5 | 7 | | 10 | | 20 | | VC3 | 5 | 9.5 | 0.5 | 1.4 | 187 | 92.2 | 0.190 | 14 |
| 10 | 35 | | 10 | W2 | | 35 | | | | 8 | 9 | 1 | 2.1 | 175 | 92.2 | 0.164 | 10 |
| 11R | 54 | 20 | 10 | | | | | | | 5 | 10 | 1 | 2.0 | 159 | 91.2 | 0.250 | 5 |
| 12R | 60 | | 1 | | | 21 | | | | 8 | 9 | 1 | 2.4 | 140 | 90.1 | 0.335 | 3 |
| 13R | 25 | | 8 | | 45 | | 4 | | | 8 | 9 | 1 | 0.6 | 148 | 92.3 | 0.162 | 3 |
| 14R | 60 | | 5 | | 10 | | 9 | | | 6 | 10 | | | 158 | 90.0 | 0.329 | 2 |
| 15R | 45 | | 8 | | | 30 | | | | 9 | 8 | | | 152 | 90.5 | 0.311 | 1.5 |
| 16 | 51 | | 3.6 | | 20 | | 20 | | | 5 | | 0.4 | 0.7 | 125 | 93.0 | 0.091 | 5 |
| 17 | 35 | 10 | | | 15 | | 10 | | | 10 | 17 | 3.0 | 1.0 | 233 | 89.1 | 0.365 | 27 |
| 18 | 45 | 7 | 7 | | | 20 | | ZrC 5 | | 4 | 11 | 1.0 | 1.5 | 150 | 92.5 | 0.153 | 11 |
| 19 | 30 | | 3 | | 7 | 20 | 15 | | VC 5 | 6 | 12 | 2.0 | 2.0 | 141 | 92.4 | 0.166 | 9 |
| 20 | 35 | | 10 | | 10 | | | HfC 3 | | 20 | 13 | 9.0 | 0.8 | 295 | 88.2 | 0.552 | 24 |
| 21 | 55 | | | Mo 10 | 3.7 | | 9 | | NbC 5 | 8 | 8 | 1.3 | 9.0 | 163 | 91.5 | 0.210 | 10 |
| 22 | 40 | 7 | 5 | | | 20 | 11 | | | 5 | 10 | 2.0 | 0.6 | 150 | 91.8 | 0.187 | 8 |
| 23R | 65 | | 6 | | | | 10 | | | 6 | 10 | 3.0 | 0.4 | 130 | 91.6 | 0.255 | 2 |
| 24R | 50 | 10 | | | | 10 | | ZrC 10 | | 9 | 9 | 2.0 | 11.0 | 128 | 90.4 | 0.277 | 2 |
| 25R | 60 | | 5 | | 10 | | | | NbC 2 | 10 | 10 | 13.0 | 4.0 | 130 | 89.5 | 0.335 | 4 |

*parts by volume relative to 100 parts by volume of the nitrides in the Cermet Material Powder Composition

TABLE 3

| | Conditions for Cutting Tests 1 | 2 |
|---|---|---|
| Cutting Manner | Continuous dry cutting of rod material | Dry milling |
| Work Piece | JIS S45C | JIS SCM440 (100 × 100) |
| Cutting Speed | 250 m/min | 100 m/min |
| Feeding Rate | 0.3 mm/rev | 0.3 mm/rev |
| Depth of Cut | 1.0 mm | 1.5 mm |
| Cutting Time | 10 minutes | — |
| Shape of Tip | SNGN432 (honing 0.1 × 25°) | SNGN 432 (honing 0.1 × 25°) |
| Evaluation | Wear of clearance face after 10-minute cutting $V_B$(mm) | Cutting cycles until tip fracture |

What is claimed is:

1. A process for producing titanium nitride base cermet with a high toughness comprising the steps of:

admixing 0.5 to 10 parts volume of a carbon powder with a cermet material powder in an amount of 100 parts by volume based on nitrides in the cermet material powder, the cermet material powder essentially consisting of, by weight, 40 to 93% TiN, 2 to 15% of one or more selected from the group consisting of metals of the Group VIa of the periodic table and carbides thereof, 4.7 to 35% of iron group metal, and 0.3 to 10% of AlN with the balance being inevitable impurities, forming the resultant mixture into a compact, and sintering the resultant compact, whereby, when said resultant compact is sintered, said AlN is substantially decomposed.

2. A process for producing titanium nitride base cermet with a high toughness comprising the steps of:

admixing 0.5 to 10 parts by volume of a carbon powder with a cermet material powder in an amount of 100 parts by volume based on nitrides in the cermet material powder, the cermet material powder essentially consisting of, by weight, 40 to 93% TiN, 2 to 15% of one or more selected from the group consisting of metals of the Group VIa of the periodic table and carbides thereof, 4.7 to 35% of iron group metal, and 0.3 to 10% of AlN with the balance being inevitable impurities, forming the resultant mixture into a compact, and sintering the resultant compact, wherein half or less of TiN is replaced with one or more of the carbides and/or carbonitrides of metals of Groups IVa and Va of the periodic table, provided that the amount of TiN in the cermet material powder is not less than 30% by weight, whereby, when said resultant compact is sintered, said AlN is substantially decomposed.

3. A process as defined in claim 1 or 2, wherein the impurities encompass, by weight less 1.0% $O_2$, less 1.5% Fe, less 0.5% Cr and traces of Na, Ca, Si, S, Cu, Mg, P and B.

4. A process as defined in claim 2, wherein the carbide(s) and/or carbonitride(s) of the metals from the Groups IVa and Va of the periodic table is (are) one or more selected from the group consisting of TiC, ZrC, HfC, VC, NbC, TaC and TiCN.

5. A process as defined in claim 1 or 2, wherein metals of the Group VIa of the periodic table are Cr, Mo, W or a mixture thereof.

6. A process as defined in claim 1 or 2, wherein iron group metal is Ni, Co or a mixture thereof.

7. A process as defined in claim 6, wherein TiN is 35 to 90% by weight.

8. A process as defined in claim 7, wherein TiN is 35 to 70% by weight.

9. A process as defined in claim 1 or 2, wherein AlN is 0.5 to 8% by weight.

10. A process as defined in claim 9, wherein AlN is 0.5 to 4% by weight.

11. A process as defined in claim 1 or 2, wherein metals of the Group VIa of the periodic table and/or carbides thereof amount to 4 to 15% by weight.

12. A process as defined in claim 6, wherein iron group metal amounts to 5 to 25% by weight.

13. A process as defined in claim 12, wherein iron group metal amounts to 5 to 18% by weight.

14. A process as defined in claim 1 or 2, wherein C amounts to 1 to 3 parts by volume based on nitrides in the cermet material powder.

15. A process as defined in claim 1 or 2, wherein the sintering is carried out at a temperature between 1300° and 1700° C. under an inert vacuum atmosphere.

16. A process as defined in claim 15, wherein the sintering is carried out at a temperature between 1450° and 1600° C.

17. A cermet produced by the process as defined in claim 1 or 2.

18. A cermet as defined in claim 17, wherein the Rockwell hardness HRA is 88.0 or more.

19. A cermet as defined in claim 17, wherein the Rockwell hardness HRA is 90.0 or more.

20. A cermet produced by the process as defined in claim 8.

21. A cermet produced by the process as defined in claim 10.

22. A cermet produced by the process as defined in claim 14.

* * * * *